US012768086B2

(12) United States Patent
Zhou et al.

(10) Patent No.: US 12,768,086 B2
(45) Date of Patent: Oct. 20, 2026

(54) INTEGRATED KNIT LOOP CLOSURE

(71) Applicant: Rothy's, Inc., San Francisco, CA (US)

(72) Inventors: Shengquan Zhou, Dongguan (CN); La Vion Gibson, San Franciso, CA (US); William Roth Martin, San Francisco, CA (US)

(73) Assignee: Rothy's, Inc., San Francisco, CA (US)

( * ) Notice: Subject to any disclaimer, the term of this patent is extended or adjusted under 35 U.S.C. 154(b) by 129 days.

(21) Appl. No.: 18/353,561

(22) Filed: Jul. 17, 2023

(65) Prior Publication Data

US 2025/0019872 A1 Jan. 16, 2025

(30) Foreign Application Priority Data

Jul. 13, 2023 (CN) ..... 202310864691.9

(51) Int. Cl.
*D04B 1/24* (2006.01)
*A43B 3/12* (2006.01)

(52) U.S. Cl.
CPC ..... *D04B 1/24* (2013.01); *A43B 3/124* (2013.01); *D10B 2501/043* (2013.01)

(58) Field of Classification Search
CPC ..... D10B 2501/043
See application file for complete search history.

(56) References Cited

U.S. PATENT DOCUMENTS

| | | | | |
|---|---|---|---|---|
| 4,015,444 | A * | 4/1977 | Johnson | D04B 15/08 66/57 |
| 5,547,733 | A * | 8/1996 | Rock | D04B 1/14 2/400 |
| 6,230,523 | B1 * | 5/2001 | Apollonio | D04B 35/04 66/123 |
| 6,397,638 | B1 * | 6/2002 | Roell | D04B 15/565 66/61 |
| 8,839,529 | B1 * | 9/2014 | Levy | A43B 3/248 24/442 |
| 10,383,388 | B2 * | 8/2019 | Podhajny | D04B 1/02 |
| 11,633,001 | B2 * | 4/2023 | Podhajny | D04B 1/02 36/83 |
| 2002/0026815 | A1 * | 3/2002 | Busi | D04B 1/26 66/185 |
| 2004/0022993 | A1 * | 2/2004 | Wildeman | D04B 23/10 428/92 |
| 2005/0118389 | A1 * | 6/2005 | Wildeman | B32B 27/12 428/101 |
| 2008/0163650 | A1 * | 7/2008 | Sytz | D04B 1/02 66/194 |
| 2015/0250256 | A1 * | 9/2015 | Podhajny | A43B 23/042 36/83 |
| 2018/0142389 | A1 * | 5/2018 | Diaz | A41D 31/102 |
| 2019/0335841 | A1 * | 11/2019 | Podhajny | A43B 23/042 |
| 2020/0229531 | A1 * | 7/2020 | Driscoll | A43B 3/122 |
| 2022/0127764 | A1 * | 4/2022 | Colosio | D04B 1/104 |
| 2022/0205152 | A1 * | 6/2022 | Gladish | A41B 11/04 |

* cited by examiner

*Primary Examiner* — Jocelyn Bravo
(74) *Attorney, Agent, or Firm* — ArentFox Schiff LLP

(57) ABSTRACT

A knit article having an integrated loop portion of a hook and loop fastener. The integrated loop portion is knitted and integrated into the knit article.

14 Claims, 17 Drawing Sheets

INTEGRATED KNIT LOOP CLOSURE

CROSS-REFERENCE TO RELATED APPLICATION

This application claims priority to Chinese Patent Application No. 202310864691.9, filed on Jul. 13, 2023, the entire contents of which are expressly incorporated herein.

FIELD

The present disclosure generally relates to a knitted article with an integrated loop closure and methods of forming a knitted article with an integrated loop closure.

OVERVIEW

Automated knitting and 3D knitting technology has revolutionized the textile industry by enabling the creation of complex, customizable, and functional fabrics. Unlike traditional knitting methods, which required time-consuming and labor-intensive processes to form articles, automated knitting and 3D knitting allow for the quick an efficient production of flat, cylindrical, and in the case of 3D knitting, intricate 3D shapes, including clothing, footwear, and other textiles.

Automated and 3D knitting technology relies on computer-controlled knitting machines that can produce three-dimensional shapes by varying the placement and tension of the yarn or thread. These machines can be programmed to produce a wide range of shapes and patterns, enabling designers to create fabrics with specific functional properties, such as elasticity, strength, and breathability.

There are several advantages to using automated and/or 3D knitting technology over traditional manufacturing methods. For one, knitting can reduce waste and save time and resources, as it eliminates or reduces the need for cutting and sewing multiple pieces together. Additionally, knitting allows for greater customization and design flexibility, enabling designers to create unique and complex structures that are not possible with traditional methods.

Despite the potential benefits of the aforementioned knitting technologies, additional improvements can be made to incorporate features that improve the functionality of goods formed by automated knitting technology.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

FIGS. 10A-101 are examples of a stitching method according to aspects of the disclosure.

DETAILED DESCRIPTION

Figure 1A:
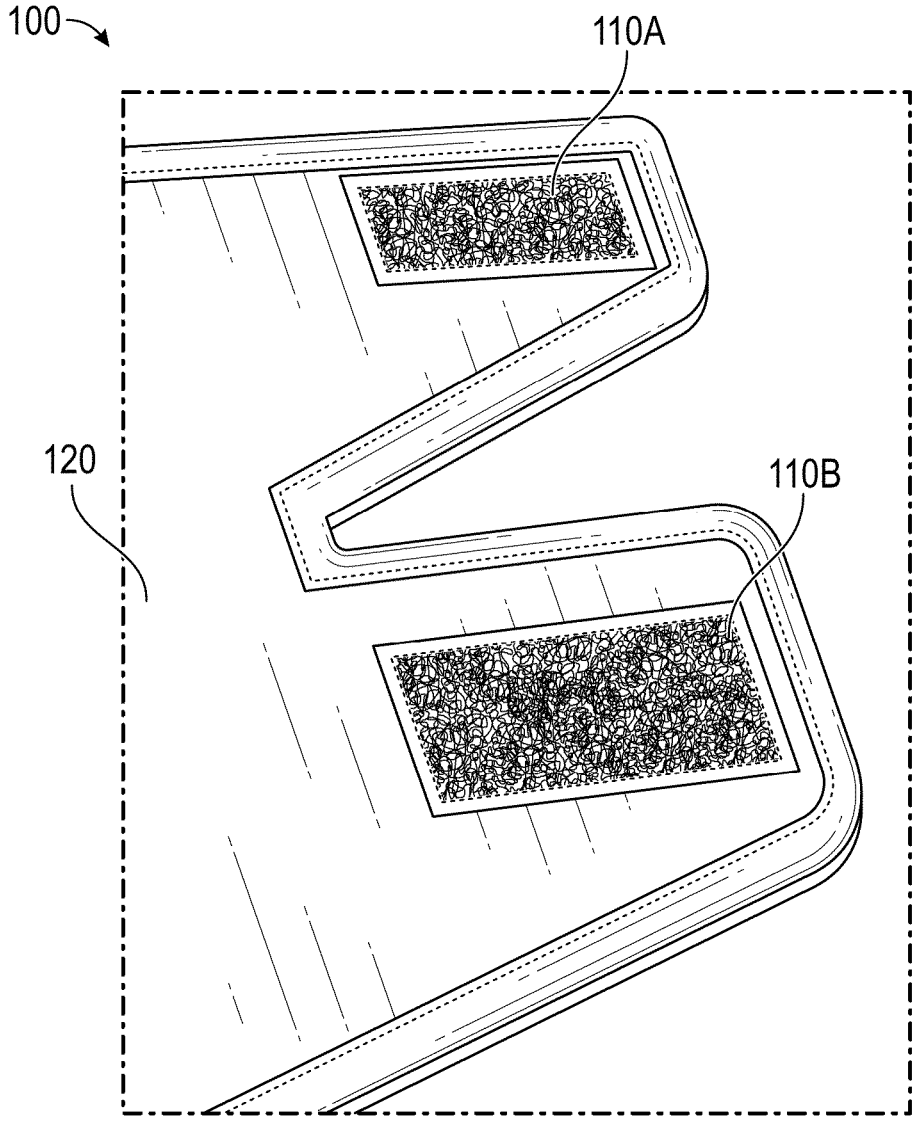
FIG. 1A shows a knit article with an integrated loop closure according to aspects of this disclosure.

The detailed description set forth below in connection with the appended drawings is intended as a description of various configurations and is not intended to represent the only configurations in which the concepts described herein may be practiced. The detailed description includes specific details for the purpose of providing a thorough understanding of various concepts. However, it will be apparent to those skilled in the art that these concepts may be practiced without these specific details. In some instances, well known components are hidden from view to avoid obscuring such concepts. In addition, it is appreciated that the figures provided herewith are for explanation purposes to persons ordinarily skilled in the art and that the drawings are not necessarily drawn to scale.

I. Terminology

Reference throughout this specification to one aspect, an aspect, one example or an example means that a particular feature, structure or characteristic described in connection with the embodiment or example may be a feature included in at least example of the present invention. Thus, appearances of the phrases in one aspect, in an aspect, one example or an example in various places throughout this specification are not necessarily all referring to the same example. Furthermore, the particular features, structures or characteristics may be combined in any suitable combinations and/or sub-combinations in one or more embodiments or examples.

Throughout the disclosure, the terms substantially or approximately may be used as a modifier for a geometric relationship between elements or for the shape of an element or component. While the terms substantially or approximately are not limited to a specific variation and may cover any variation that is understood by one of ordinary skill in the art to be an acceptable level of variation, some examples are provided as follows. In one example, the term substantially or approximately may include a variation of less than 10% of the dimension of the object or component. In another example, the term substantially or approximately may include a variation of less than 5% of the object or component. If the term substantially or approximately is used to define the angular relationship of one element to another element, one non-limiting example of the term substantially or approximately may include a variation of 5 degrees or less. These examples are not intended to be limiting and may be increased or decreased based on the understanding of acceptable limits to one of skill in the relevant art.

For purposes of the disclosure, directional terms are expressed generally with relation to a standard frame of reference when the aspects or articles described herein are in an in-use orientation. In some examples, the directional terms are expressed generally with relation to a left-hand coordinate system.

Terms such as a, an, and the, are not intended to refer to only a singular entity, but also include the general class of which a specific example may be used for illustration. The terms a, an, and the, may be used interchangeably with the term at least one. The phrases at least one of and comprises at least one of followed by a list refers to any one of the items in the list and any combination of two or more items in the list. All numerical ranges are inclusive of their endpoints and non-integer values between the endpoints unless otherwise stated.

The terms first, second, third, and fourth, among other numeric values, may be used in this disclosure. It will be understood that, unless otherwise noted, those terms are used in their relative sense only. In particular, certain components may be present in interchangeable and/or identical multiples (e.g., pairs). For these components, the designation of first, second, third, and/or fourth may be applied to the components merely as a matter of convenience in the description.

II. Overview

A typical hook and loop fastening system has a hook portion with a plurality of small hooks that 'mate' or otherwise removeably connect to a loop portion having a plurality of small loops, attaching temporarily, until pulled apart with sufficient force. Traditional hook and loop fastening systems may be referred to or commonly known as VELCRO®, and typically include a hook side and a loop side that can be pressed together to mate the hook and the loop side. Typically, hook and loop fastener closure systems require a hook and loop member or pre-made fabric to be glued, bonded or stitched to an article. The bonding and/or stitching of the hook and/or loop members can lead to irritation, delamination issues, and/or cause design constraints which may have undesirable characteristics in the finished article. For example, stitching of a hook and/or loop panel may increase the stiffness or decrease elasticity of the finished article. Further, the fastening of hook and/or loop members to an article decreases efficiency of making an article and/or results in wasted materials.

This overview, and the detailed description that follows, has been presented for purposes of illustration and description. It is not intended to be exhaustive nor to limit the disclosure to the forms described. Numerous modifications are possible considering the teachings herein, including any combination of the different examples described herein. Some of those modifications have been discussed and others will be understood by those skilled in the art. The various aspects were chosen and described to best illustrate the principles of the present disclosure and various aspects as are suited to the particular use contemplated. The scope of the present disclosure is, of course, not limited to the examples or aspects set forth herein but can be employed in any number of applications and equivalent devices by those of ordinary skill in the art. Rather, it is hereby intended the scope be defined by the claims appended hereto.

III. Detailed Examples

FIG. 1A shows one example of an article 100 having an integrated loop portion (i.e., loop portions 110A and 110B) as disclosed herein. The integrated loop portion 110A and/or 110B is configured to interact with or otherwise removeably connect to a corresponding hook structure allowing for fastening of the hook and loop structures. As discussed in further detail below, the loop portions 110A and/or 110B are integrated with the knit article 120, i.e., the plurality of loops of each loop portion 110A and/or 110B are formed as the article 100 is knitted and the individual loops of the loop portion are locked in place or otherwise prevented from unwanted movement via the knitting process described in further detail below.

Figure 1C:
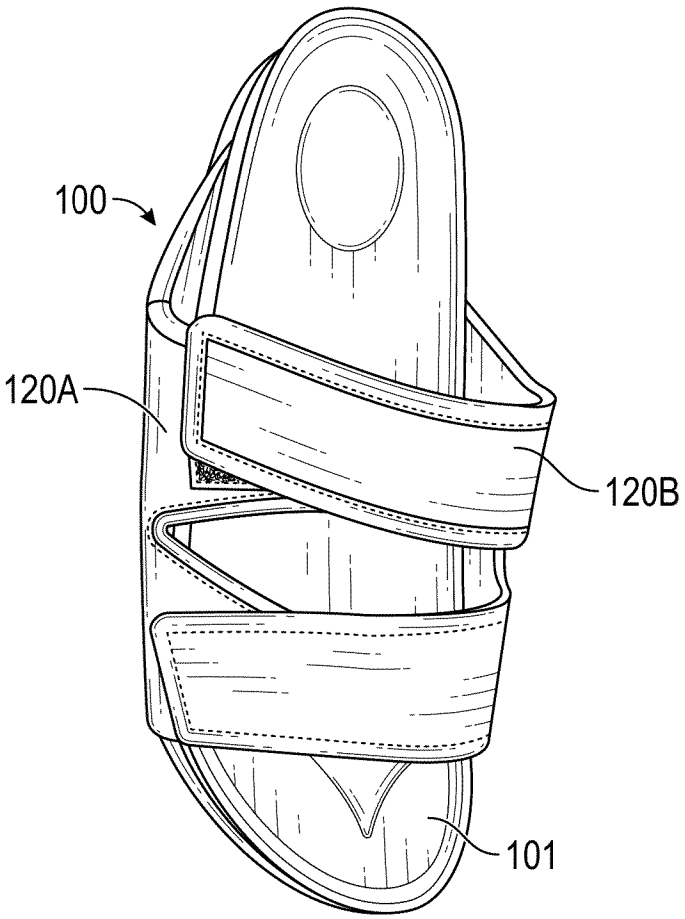
FIG. 1C shows an example knit article with an integrated loop closure according to aspects of this disclosure with hook-and-loop fasteners in the closed configuration.
Figure 1B:
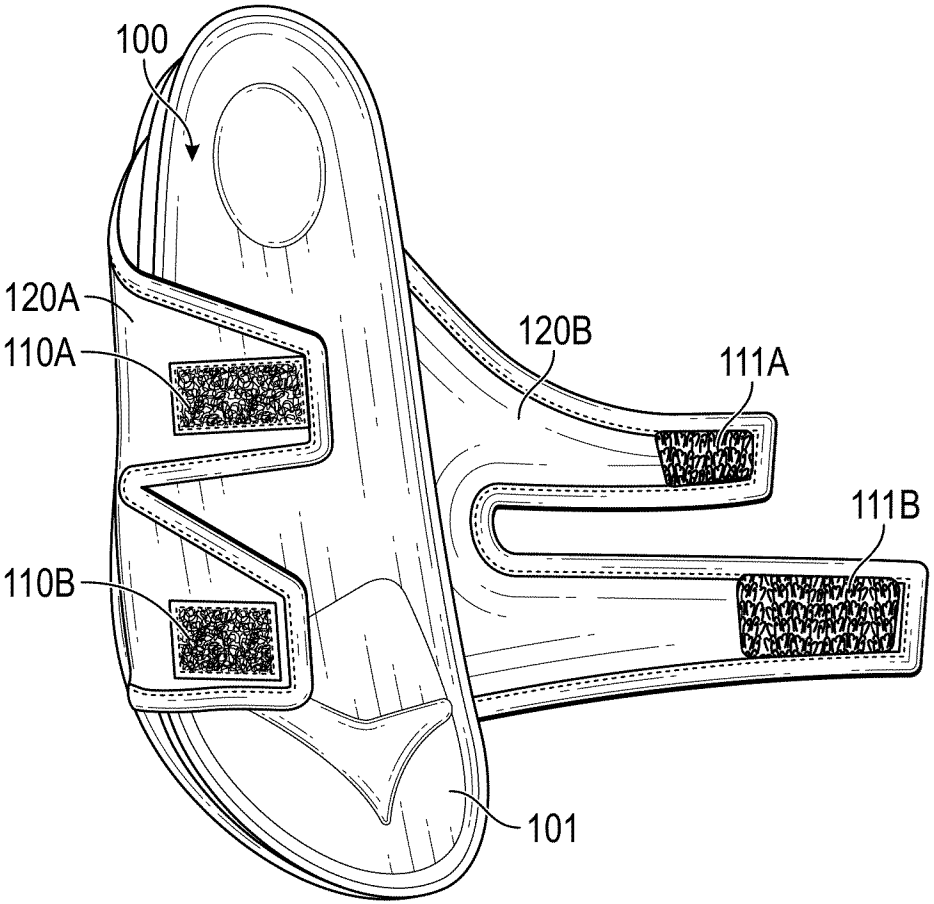
FIG. 1B shows an example knit article with an integrated loop closure according to aspects of this disclosure with hook-and-loop fasteners in the open configuration.

The article 100 may for example be a portion of a shoe, sandal, or other footwear. For example, FIGS. 1B and 1C show examples of a sandal incorporating the article and/or features of the article described herein. For example, the article 100 may be connected to a sandal sole 101. The article 100 may be connected to the sandal sole 101 via any known method including but not limited to stitching, fusing, welding (e.g., friction welding), gluing or otherwise adhering, or any combination thereof. FIG. 1B shows an example of the loop portion(s) 110A and/or 110B disconnected from the hook portions 111A and/or 111B of the article. FIG. 1C shows an example of the loop portions(s) 110A and/or 110B connected or otherwise joined to the hook portions 111A and/or 111B. The hook portions 111A and/or 111B may be connected to a second article 120B, which may also be connected to the sandal sole 101 in a similar fashion. The second article may have a knitted portion or portions that are formed like or identically to the first article 120A. In some examples, the aforementioned first and second articles 120A and/or 120B may be formed as a single continuous article. In some examples, both the first and second articles 120A and/or 120B, or combination thereof in aspects where the two are formed as a single continuous article may be formed using a weft-knitting technique.

While examples are provided herein, it is noted that the current disclosure is not limited to a particular article. Some additional examples of implementations of the current disclosure include but are not limited to bags, purses, jackets, coats, sweaters, and/or covers to name some additional examples.

The article 100 may for example be knitted and include sections or knitted portions 120 that are formed of interlocking fiber loops, which may alternatively be referred to as stitches throughout this disclosure. In some examples, the stitches or loops or series of stitches or loops may be referred to throughout the disclosure as a textile. The interlocking fiber loops may be formed of any yarn or thread formed of natural or synthetic materials or combinations thereof. Fibers include any one or a combination of natural or synthetic materials. Natural fibers include cotton, wool, alpaca, hemp, coconut fibers or silk, for example. Among the synthetic fibers are polymer-based fibers such as Nylon™, polyester, elastane or spandex, or Kevlar™, which may be produced as classic fibers, high-performance fibers, or technical fibers. Yarn and thread are terms for a structure of one or several fibers that is long in relation to its diameter. A fiber is a flexible structure that is rather thin in relation to its length. The terms yarn, thread, or textile may be used interchangeably throughout the disclosure.

The article 100 may for example be formed using an automated flat-knitting, fly-knitting and/or 3D knitting process via an automated or semi-automated knitting machine, that may employ any one or combination of weft-knitting and/or warp knitting to form the aforementioned interlocking fiber loops or stitches.

The stitches may for example be weft-knitted and/or warp-knitted. In weft-knitted fabrics and single-thread warp-knitted fabrics, the stitch formation may include at least one thread or yarn, with the thread running in a longitudinal direction of the product (at a right angle to the direction in which the product is made during the manufacturing process). In warp-knitted fabrics, the stitch formation may include at least one warp sheet (a plurality of so-called warps), with the stitch-forming threads running in a longitudinal direction (in the direction in which the product is made during the manufacturing process).

Figure 2A:
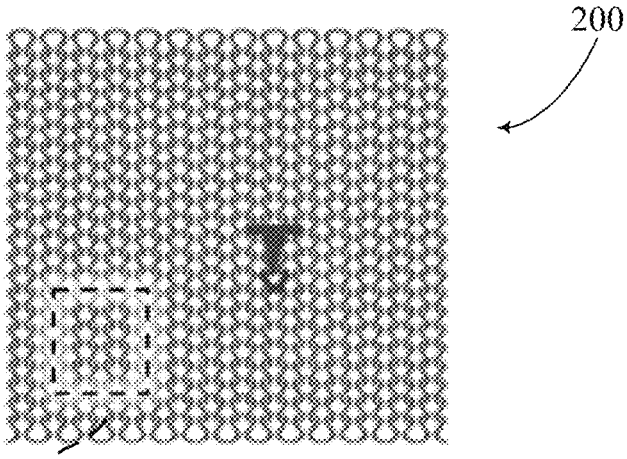
FIGS. 2A-2D show one example method of forming a knit loop according to aspects of this disclosure.
Figure 2B:
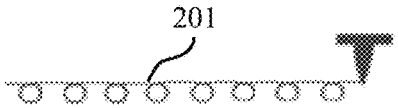
Figure 2C:
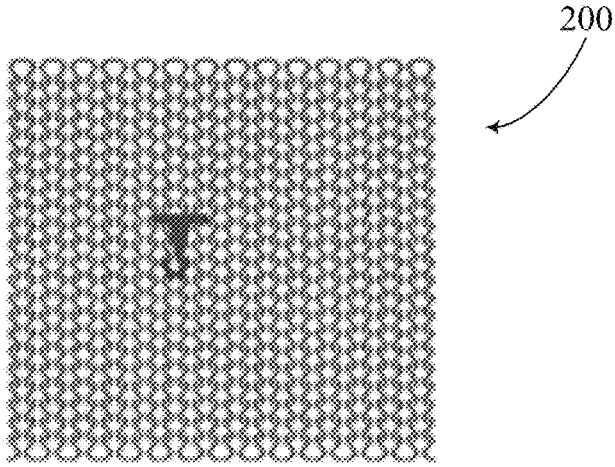
Figure 2D:
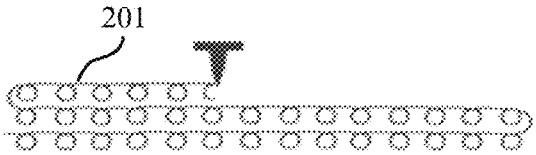
Figures 2E, 2F:
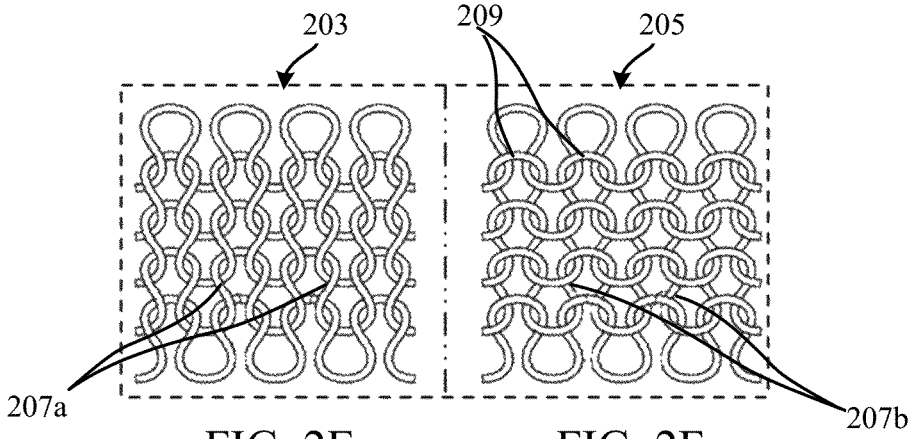
FIGS. 2E-2F are enlarged front and back views of the knit loop portion(s) in FIGS. 2A-2D.

FIGS. 2A-2D show examples of how an automated knit, 3D knit and/or fly-knit fabric of the article may be created. The article or portions of the article 100 may be formed by interlocking loops or stitches as shown in FIGS. 2A and 2C. The loops may be interlocked as the article is formed thus creating a portion of the article that expands as additional yarn is knitted thereon. For example, if the article or relevant portion of the article is weft-knitted, the article or portion of the article may be created by knitting one thread 201 from the left to the right (e.g., as shown in FIGS. 2B and 2D) using interlocking stitches as shown in FIGS. 2A and 2C. FIG. 2E is a close-up front view of an example of the front side 203 of article 100 (also referred to as the front loop fabric side) and FIG. 2F is a close-up back view (also referred to as the back loop fabric side) of a weft-knitted fabric. The legs 207*a* and 207*b* are covered on the back loop fabric side 207*b*, but not on the front loop fabric side 207*a*. It is noted that the aforementioned aspects are provided as examples only and may include or exclude features described herein. For example, filler yarn (not shown) may be provided either in-part or throughout the article. The filler yarn may be a length of a yarn placed between two wales 209 (FIG. 2F) in a longitudinal direction and may be held or otherwise inserted between transverse threads of other weave elements. Combining a filler yarn with other weave elements may be used to influence the properties of the weft-knitted fabric or to achieve various pattern effects. Elasticity or stretchability of the weft-knitted fabric in the direction of the wales may, for example, be reduced by the filler yarn.

Further, the article may be formed fully or at least in part by warp-knitting. Warp-knitting may utilize many threads from the top down and by interlocking the stitches of a thread with the stitches of neighboring threads. Depending on the desired pattern, the stitches of the neighboring threads are interlocked. Some examples of interlocking connections include but are not limited to pillar, tricot, 2×1 plain, satin, velvet, atlas, and twill.

The stitches described herein may be arranged above one another with joint binding sites, which as noted above may be referred to as wales. One example of a wale is shown as reference 209 in FIG. 2F. Wales may also be applicable to warp-knitting as well. Wales may run vertically through an article comprised thereof. Rows of stitches arranged next to one another, shown by way of example for a weft-knitted article with reference number 209 in FIG. 2D may be referred to as courses in both weft-knitted and warp-knitted articles. Generally, courses may run through the article in a lateral direction, for example.

Figure 2G:
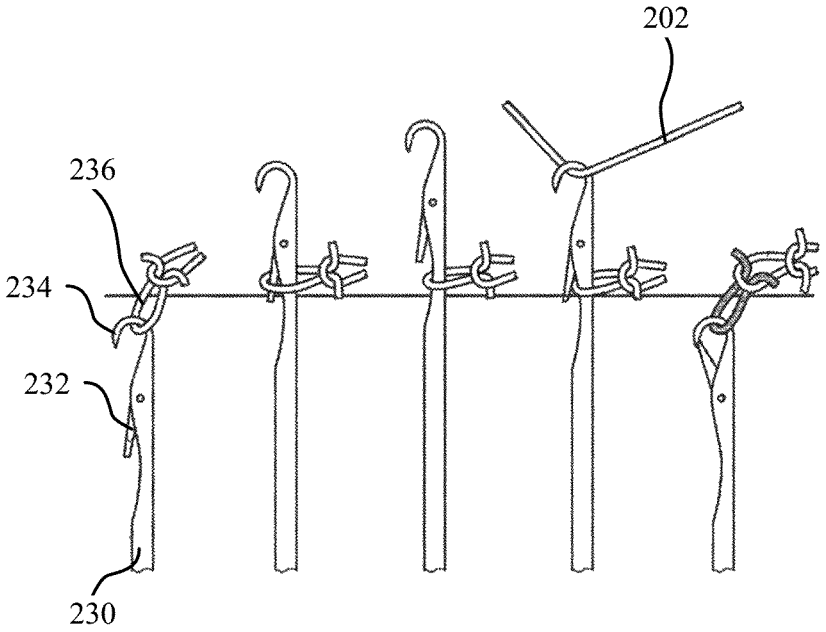
FIG. 2G shows an example of a knit loop formed by a latch needle.

The aforementioned knitted article or portion of a knitted article may be manufactured using an automated or semi-automated machine with a plurality of "needles." In some aspects of the disclosure, the "needles" may comprise latch needles 230 (FIG. 2G), each of which comprise a pivotable latch 232 and a hook 234 at an end thereof. This latch 232 closes the hook 234 of the needle 230 such that a thread or yarn 202 may be pulled through a previously formed stitch 236. In one aspect, the needles 230 may be moveable individually, so that every single latch needle may be controlled to catch a thread for stitch formation.

In one aspect of the disclosure, the knitting machine may have two parallel rows of needles (e.g., needles 230). When looked at from the side, the needles of the two rows of needles may, for example, be opposite each other and angled relative to one another (e.g., at a right-angle). The use of two rows of needles allows for a one-layered or two-layered article to be simultaneously knitted. For example, a one-layered knitted fabric may be created when stitches generated on the first row of needles are intermeshed with stitches generated on the second row of needles. In another example, a two-layered knitted fabric may be created when stitches generated on the first row of needles are not, or are only selectively intermeshed with stitches generated on the second row of needles and/or if stitches generated on the first row of needles are merely intermeshed at an end of a tow-layered weft-knitted fabric.

Accordingly, an article as described herein may be at least partially manufactured using the aforementioned method and/or machine. If only one row of needles is used, a one-layered knit is created. If two rows of needles are used, stitches of both rows of needles may be connected consistently to each other so that a resulting knit comprises a single layer. If two rows of needles are used, and stitches of both rows of needles are not connected, or are only connected along certain lines, two layers are created, for example, to form a first layer and second layer in the knit.

Three-dimensional (3D) knit articles may also be manufactured via the aforementioned machine or method(s). In addition, 3D knit articles may be formed via weft-knitting machines and/or warp-knitting machines. 3D knitting or fly-knitting (the two terms may be used interchangeably herein) may be used to form articles or portions of articles that have spatial characteristics or structure. A three-dimensional weft-knitting or warp-knitting technique allows for spatial knitwear to be manufactured in a single process and without seams, cutting, or making-up into one piece.

The spatial structure described above may be formed by varying the number of stitches in the direction of the wales. The process of varying the number of stitches, which may otherwise be referred to as forming "partial courses" may be achieved by a mechanical process referred to as "needle parking." When partial courses are formed, stitch formation temporarily occurs along only a partial width of the knitted article. The needles that are not involved in the stitch formation keep the half-finished stitches ("needle parking") until weft-knitting occurs again at the same position.

The aspects described above may be used to knit an article that has different functional areas while maintaining its contours. The structures of knitwear may be adjusted to provide functional requirements in certain areas by the stitch pattern, the yarn, the needle size, the needle distance, or the tensile strain, which is subject to the yarn that is placed on the needles being selected accordingly. In some aspects of the disclosure, two or more knit layers may be combined and/or formed at once on a weft-knitting and/or warp-knitting machine with multiple rows of needles. In the case of two or more knit layers being combined, one or more layers may be formed in separate stages and then combined such as by stitching, gluing or otherwise adhering, welding (e.g., ultrasonic or chemical welding) and/or linking.

An alternative to two-layered knit articles may include spacer weft-knitted fabric or spacer warp-knitted fabric. In this example, a spacer yarn may be weft-knitted or warp-knitted loosely between two weft-knitted or warp-knitted layers, interconnecting the two layers, and simultaneously serving as a filler. The spacer yarn may be the same material or different from one or more of the layers themselves. Spacer weft-knitted fabrics or spacer warp-knitted fabrics may also be referred to herein as three-dimensional (3D) articles, but may be different from the aforementioned 3D weft-knitted fabrics or 3D warp-knitted fabrics or articles.

When forming the aforementioned loops (e.g., loops 110A and/or 110B in FIGS. 1A and 1B), stitches may be dropped or pressed-off (the terms drop stitch and press-off stitch may be used interchangeably throughout the disclosure) to form the individual loops of the hook and loop closure portion 110A and/or 110B. The aforementioned drop-stitch may be formed by allowing one or more needles to release the prior loop without receiving a new one. The terms drop-stitch and press-off stitch may be used interchangeably throughout this disclosure.

In order for the aforementioned drop-stitch or press-off stitch to function as a loop of a hook- and loop closure, the loop must be properly secured to prevent pulling-apart of the article, for example when the hook and loop closure is to be re-opened (e.g., as shown in FIG. 1C).

In one aspect of the disclosure, any one of or combination of a step knitting, stitch crossed, and/or plating may be used to form an article with an integrated loop section. The plating stitch may be integrated into the article to ensure that the loops of the loop section remain properly fixed or anchored to the knitted article to ensure that the loop section functions properly when it is removably connected to a hook section of the article (i.e., to properly function as a hook and loop connection).

The aforementioned step knitting process includes forming stitches using yarn fed by one or more yarn feeders one-by-one based as a unit module (i.e., process) then repeating the steps to form the articles.

The stitched cross knitting process includes transferring the yarn forming the stitch from a first needle bed to a second needle bed or transferring the yarn forming the stitch from the second needle bed back to the first. Additional aspects are described below with respect to FIG. 10.

The aforementioned plating process involves two or more yarns being feed to the needles to form two different stitches, one stitch covers another. In some aspects the two different yarns being fed may be different colors and/or formed of differing materials.

While each method above is described separately any combination of the processes described above may be utilized to prevent the drop-stitched or pressed off stitches from moving when used as a loop portion of a hook and loop fastener. In a preferred example, all three methods are utilized to provide triple-locking to the drop-stitched or pressed-off stitches.

Figure 3:
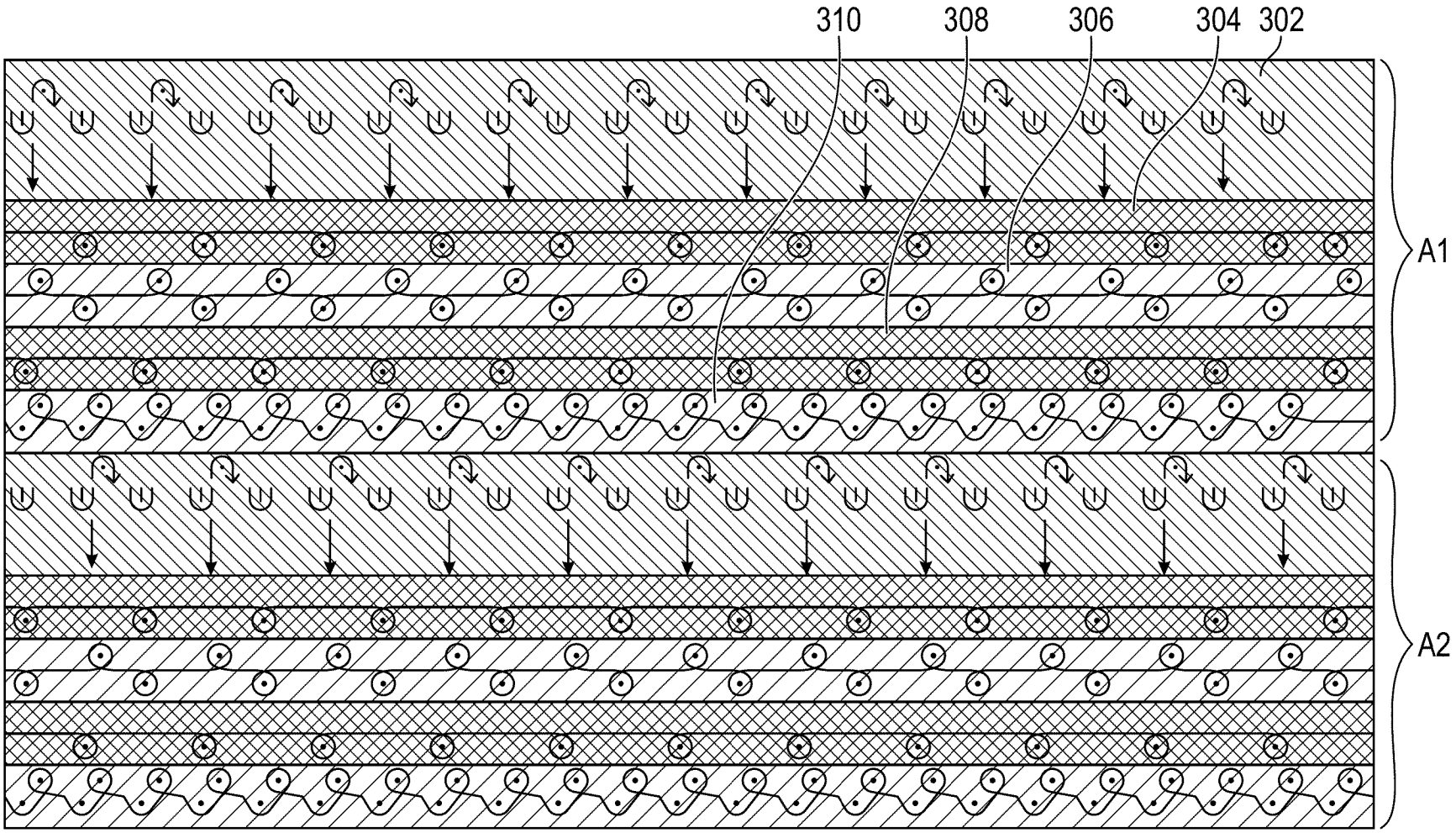
FIG. 3 is a knitting process diagram of a knit loop according to aspect of this disclosure.

FIG. 3 shows one example of a knitting process diagram of a 3D knit loop according to aspect of this disclosure. The loops of the loop fastening portion are formed by dropping stitches as shown by reference 302. It is noted that any number of stitches any number of stitches may be dropped to correspond with the size and dimensions of the loop fastening portion. The dropped stitch section may additionally include a back-stitch portion 304 and a front stitch portion 306. The section may additionally include an additional back-stitch portion 308 and a tuck-stitch portion 310. As the article loop fastening portion is formed the process may be repeated continually (e.g., as shown in sections A1 and A2) until the desired dimensioned loop portion is formed. However, when forming the loops as shown in FIG. 3, the dropped stitches that form the individual loops of the loop fastening portion would not be properly anchored to the knit structure to allow for proper function of the loop portion when a hook portion is repeatedly connected thereto and disconnected therefrom.

Figure 4:
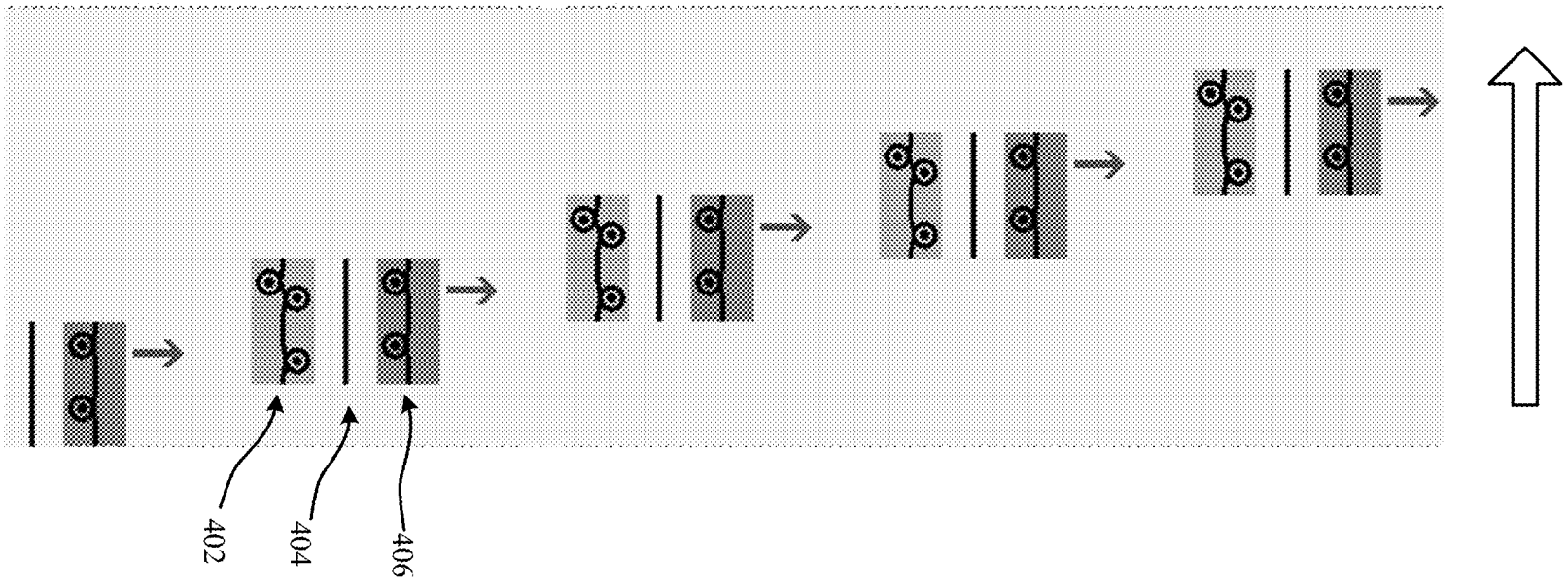
FIG. 4 is a symbol view of a knit closure according to aspects of this disclosure.
Figure 8:
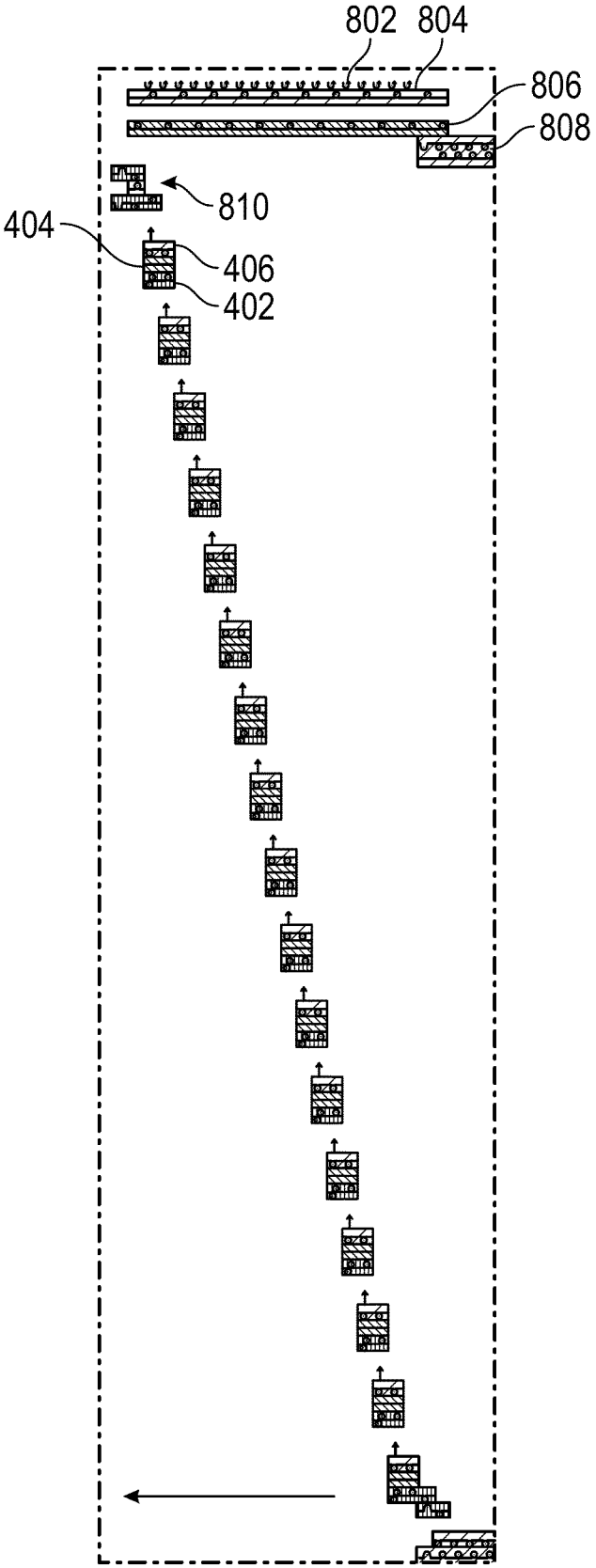
FIG. 8 is a symbol view of the integrated knit closure according to aspects of the disclosure.

FIG. 4 is a symbol view of a 3D knit closure according to aspects of this disclosure. The loop portion of the article may be knit from the right side to the left side and from bottom to top (i.e., as indicated by the arrows). As the article is knit, a loop portion is formed by dropping stitches 402 via a first yarn feeder, for example, as the article is knit using stitches 406 via the first yarn feeder as the yarn is kicked-back 404. The loop section may be plated via the first yarn feeder (e.g., 920*a* in FIGS. 9A-9K) and a second yard feeder (e.g., 920*b* in FIGS. 9A-9K) to lock the individual loops and/or the majority of the individual loops of the loop section in place. Additional steps of the loop forming process are shown in FIG. 8.

Figure 5:
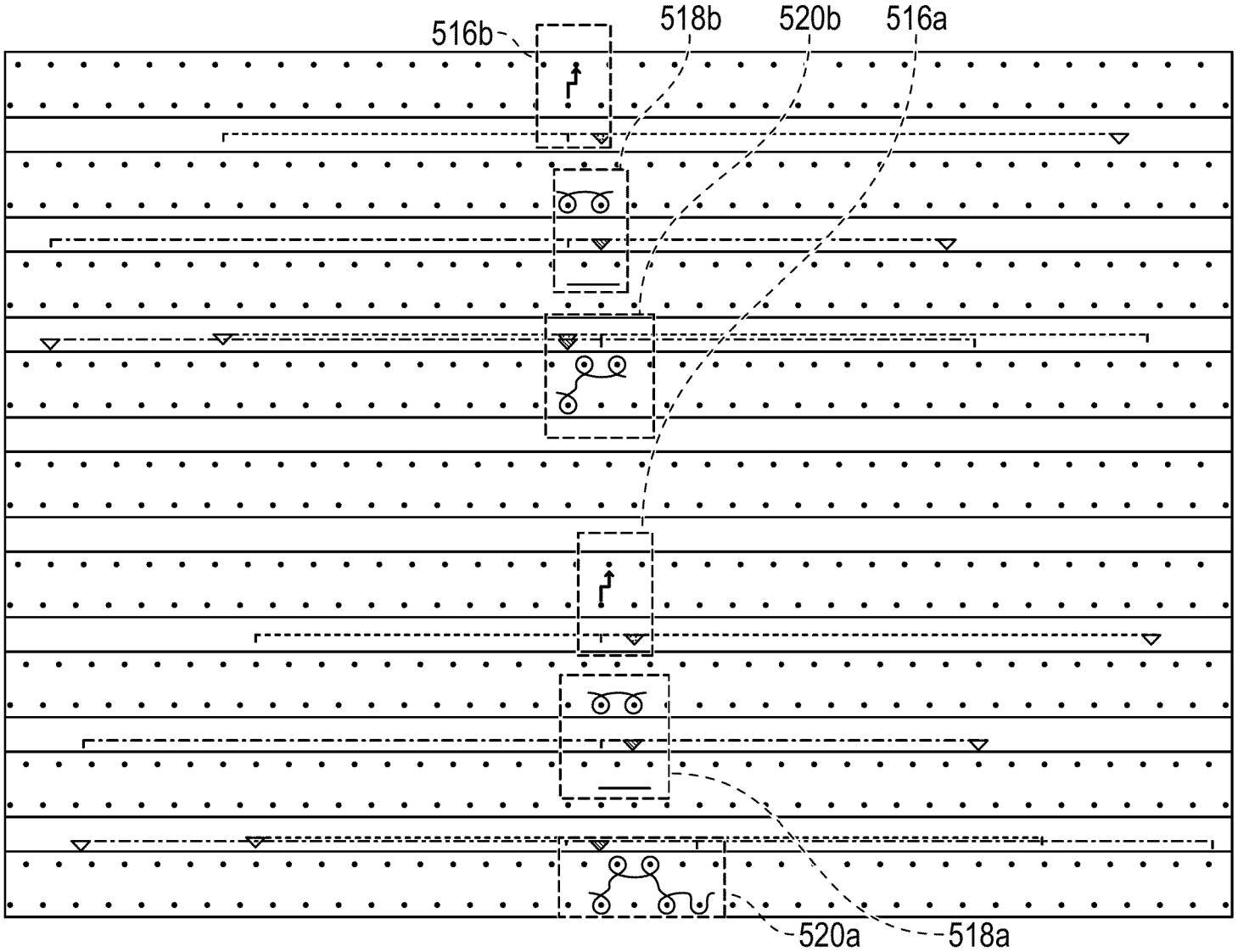
FIG. 5 is a technical view of a knit closure according to aspects of this disclosure.

FIG. 5 is a technical view of a method of forming features of the article disclosed herein. In a first step 520*a* a first yarn feeder (e.g., yarn feeder 920*a* in FIGS. 9C-9E) is run before a second yarn feeder (e.g., yarn feeder 920*b*), the two yarns are fed to form an article that is plated and/or has double the thickness of an article or portion for the article formed with a single yarn. Step 518*a* and 518*b* are kick-back steps, wherein for example the first yarn feeder (e.g., yarn feeder 920*a*) forms stitches while the second yarn feeder (e.g., yarn feeder 920*b*) is held stationary or otherwise does not interact. In a third step 516*a* and/or 516*b*, the yarn is transferred (e.g., the left from stitch to back, and press-off of the right front stitch). These steps may then be repeated, continually (e.g., steps 520*b*, 518*b*, and 516*b*) until the article or portion of the article is formed.

Figure 6:
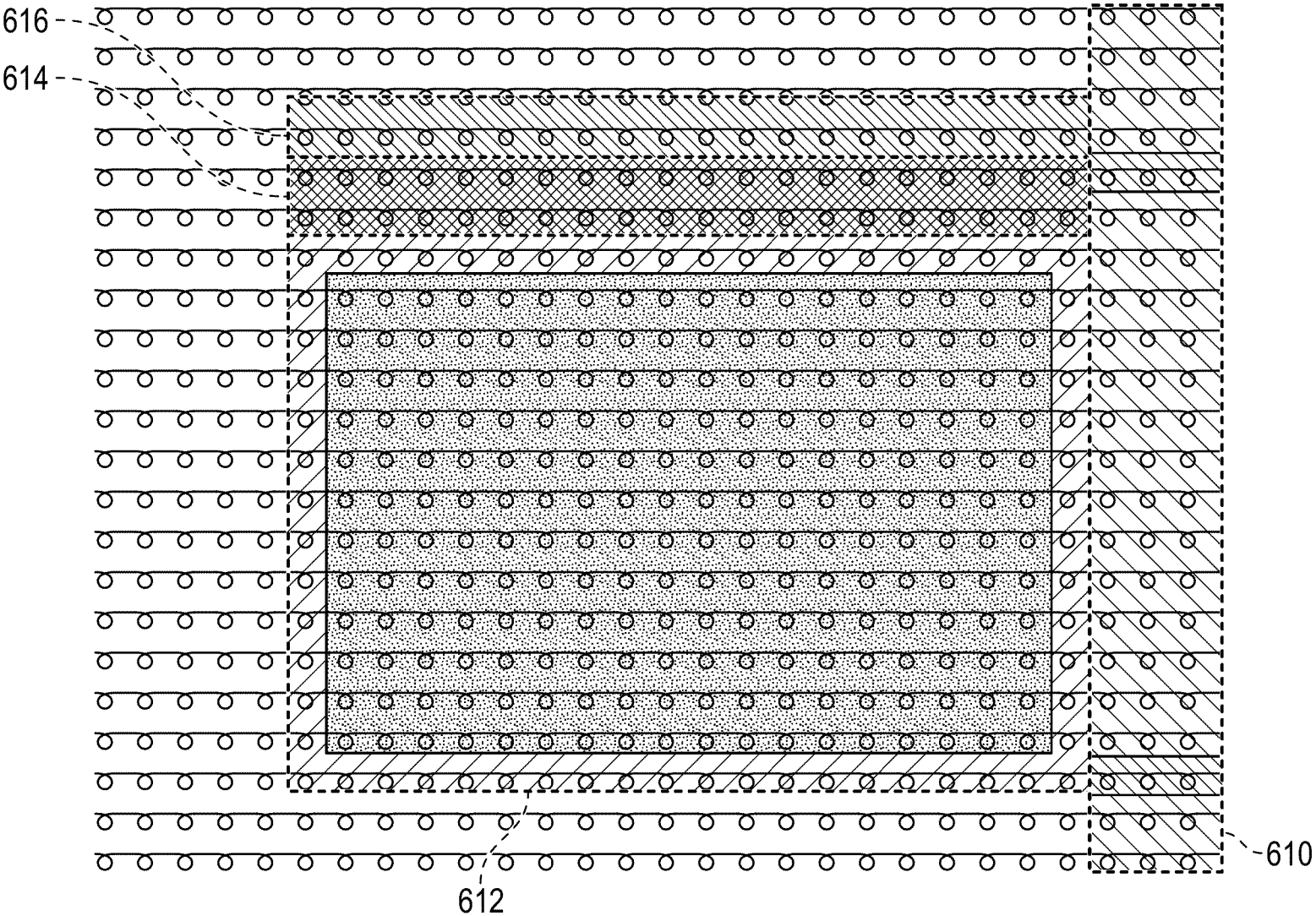
FIG. 6 is an example programming view of a method of forming a knit closure according to aspects of the disclosure.

FIG. 6 is an example programing view of a method of forming a 3D knit closure according to aspects of the disclosure and similar in principle to aspects disclosed in FIG. 5. For example, the programming may include a fabric portion 610 that borders or is otherwise outside the loop closure portion 612, a loop knit closure portion 612, which may be analogous with loop portion(s) 110A or 110*b* in FIG. 1A, for example, the programming may additionally include a horizontally connected portion of the loop knit closure 614, and a transition region 616 for preparing for the transition from the fabric portion to the loop knit closure. The transition region may include bringing in the yarns (e.g., as shown by references 919*a* and 919*b* in FIG. 9A-9K and yarn feeders (e.g., as shown by references 920*a* and 920*b* in FIGS. 9A-9K).

Figure 7:
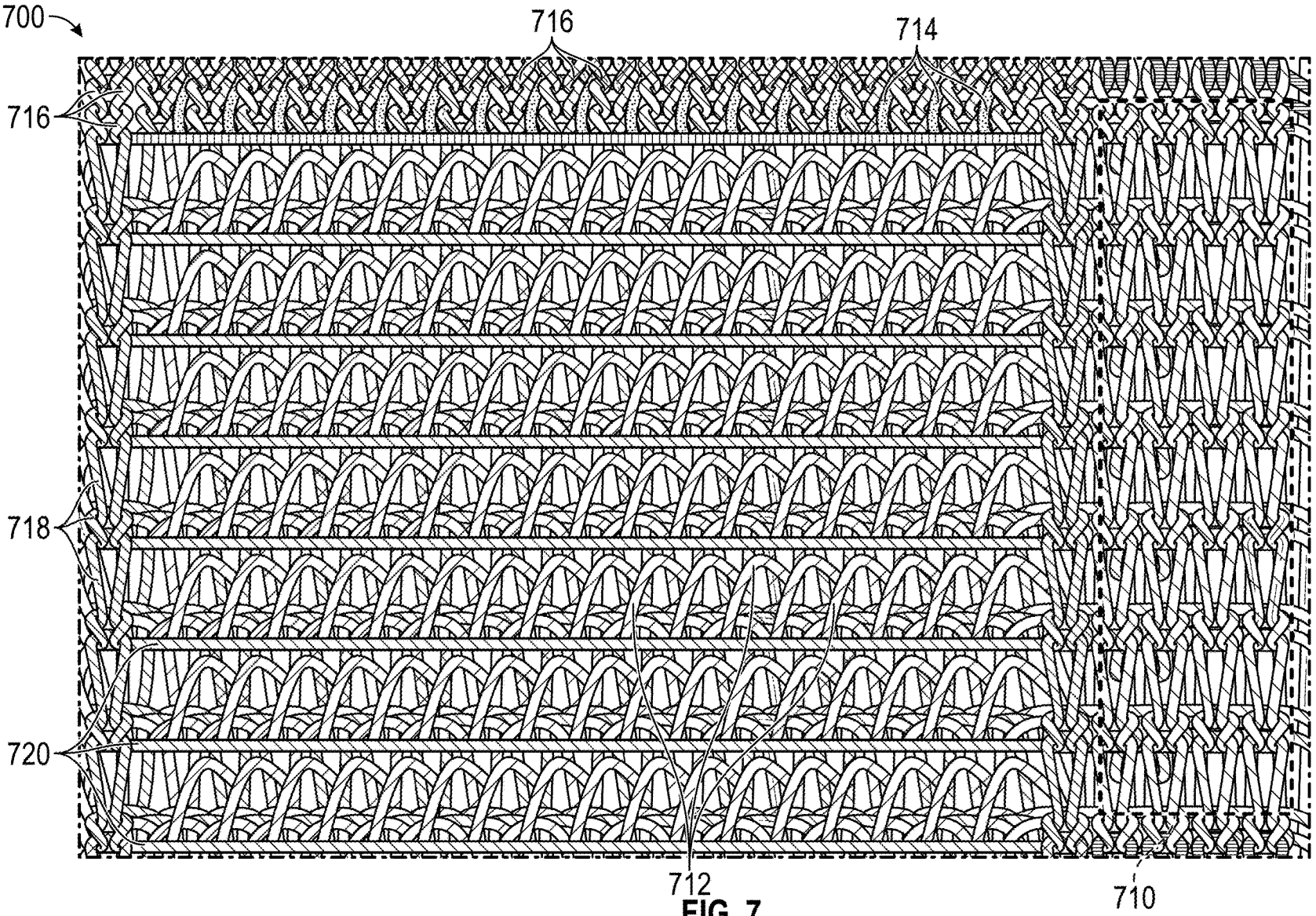
FIG. 7 is a diagram view of a physical knitted fabric knitted via the method of FIG. 6.

FIG. 7 is a diagram view of a physical knitted fabric knitted, for example, via the method in FIG. 6. The fabric of the article 700 may include a first stitch 710, the first stitch 710 may include a weft knit or stitch portion. Further, the article may include a second stitch 712 which may include a drop stitch and/or pressed of stitch to form the loop section of the loop of the integrated loop portion. The article may additionally include a third stitch 714 as a back stitch of a first yarn (e.g., yarn 919*a* in FIGS. 9A-9K). The article may additionally include a fourth stitch 716 as a back stitch of a second yarn (e.g., yarn 918*b* in FIGS. 9A-9K) The article may additionally include a fifth stitch 718 which may be a weft knit or stitched portion and may be analogous with or similar to the first stitch 710. The article may include a sixth stitch 720, which may include a float portion for kicking the two or more yarn feeders (e.g., yarn feeders 920*a* and/or 920*b* in FIGS. 9A-9K).

FIG. 8 is one example of a symbol view of the integrated knit loop closure portion according to aspects of the disclosure. The article may be knit from the right side to the left side and from bottom to top (i.e., as indicated by the arrows). The article is formed and may include the loop portion formed by dropping stitches 402 via a first yarn feeder, for example, as the article is knit using stitches 406 via the first yarn feeder as the yarn is kicked-back as shown by reference 404. The loop section may be plated via the first yarn feeder and a second yard feeder (e.g., yarn feeders 920*a* and/or 920*b* in FIG. 9C-9E) to lock the individual loops and/or the majority of the individual loops of the loop section in place. The drop stitches are formed by pressing-off stitches 802. Borders 810 may be stitched around the loop portion.

Figure 9A:
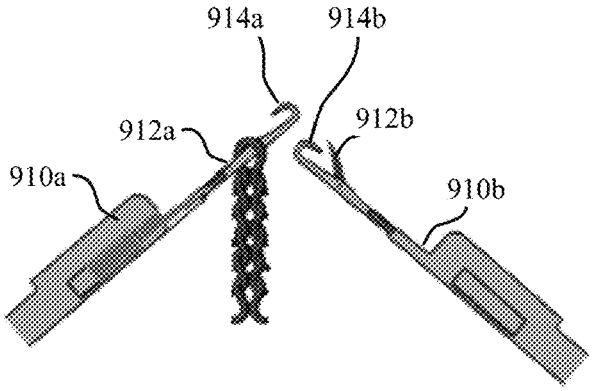
FIGS. 9A-9K are examples of a plating method to lock the integrated loop from an opposing side of the article.
Figure 9B:
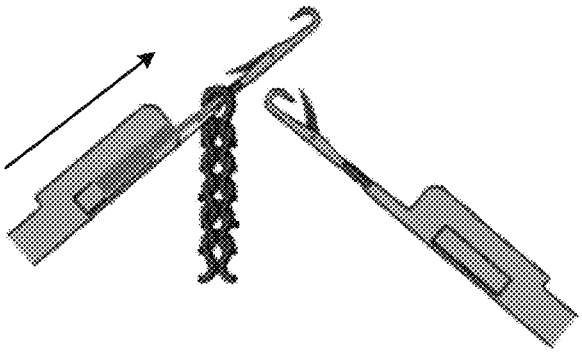
Figure 9C:
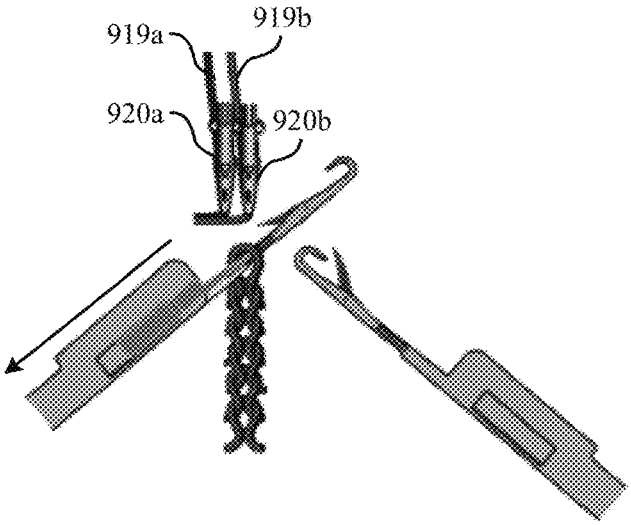
Figure 9D:
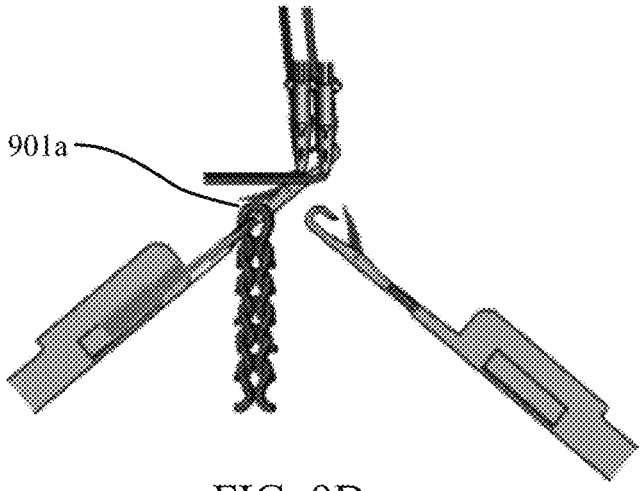
Figure 9E:
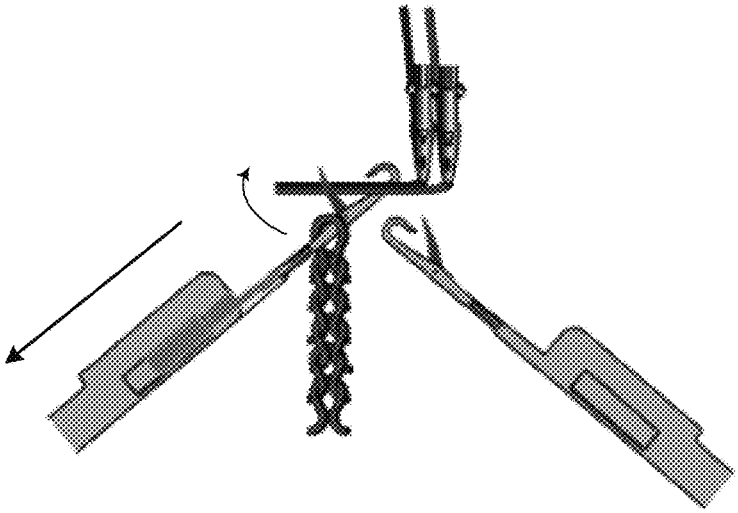
Figure 9F:
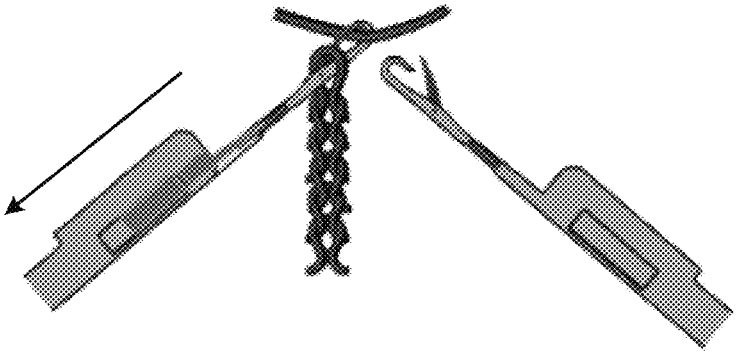

FIGS. 9A-91 show example steps for plating to secure, anchor, or otherwise fix the loops of the loop portion (e.g., loop portion 110A and/or 110B in FIGS. 1A and 1B). As mentioned above, the knitted article may be manufactured a machine with a plurality of needles, i.e., a first needle 910*a* and a second needle 910*b*, the first needle 910*a* and/or the second needle 910*b* may for example each be single needles in a row of a plurality of needles.

Each of the needles may include a corresponding pivotable latch 912*a* and/or 912*b* and a hook at ends thereof, e.g., corresponding hooks 914*a* and/or 914*b*. In one aspect of the disclosure, each one of the needles 910*a* and/or 910*b*, including the rows of needles (not shown) may be moveable individually, so that every single latch needle may be controlled to catch a thread for stitch formation. It is noted that FIGS. 9A-9K show various stages of the plating process. To avoid obstruction of the views, reference numbers are only provided in FIGS. 9B-9K where necessary to provide further clarification from the labeled components in FIG. 9A.

Figure 9G:
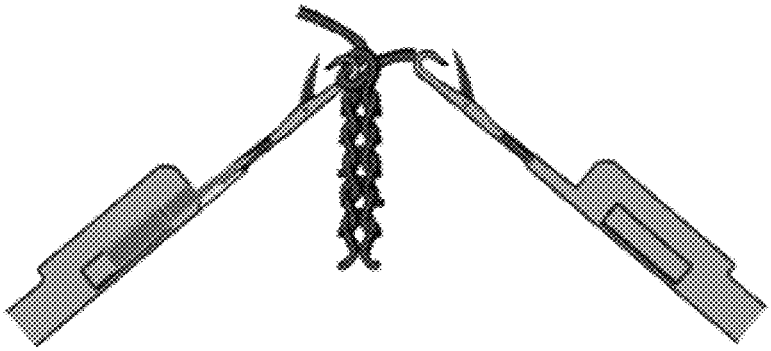
Figure 9H:
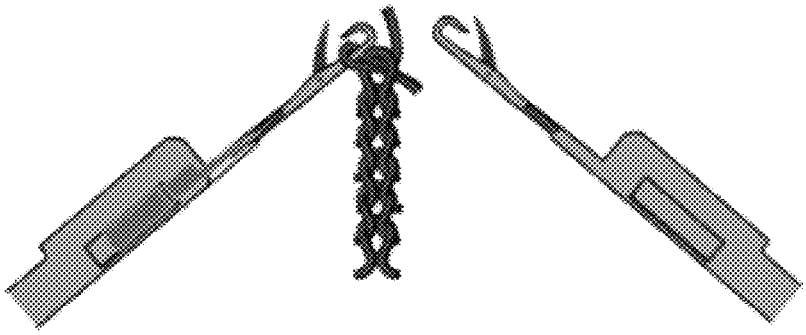
Figure 9I:
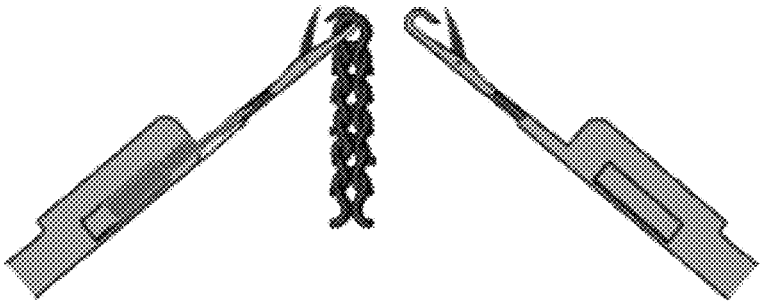
Figure 9J:
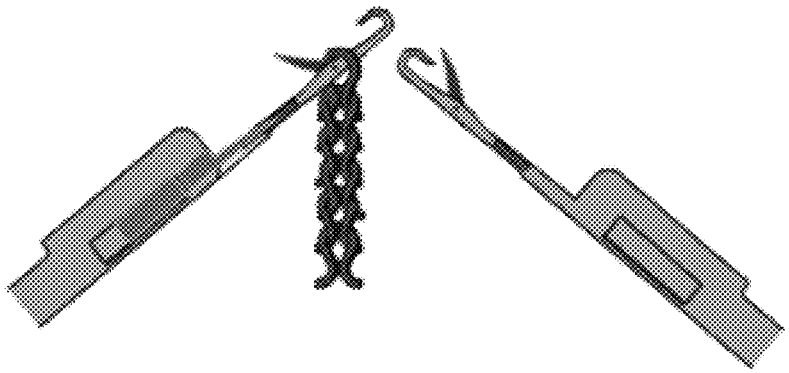
Figure 9K:
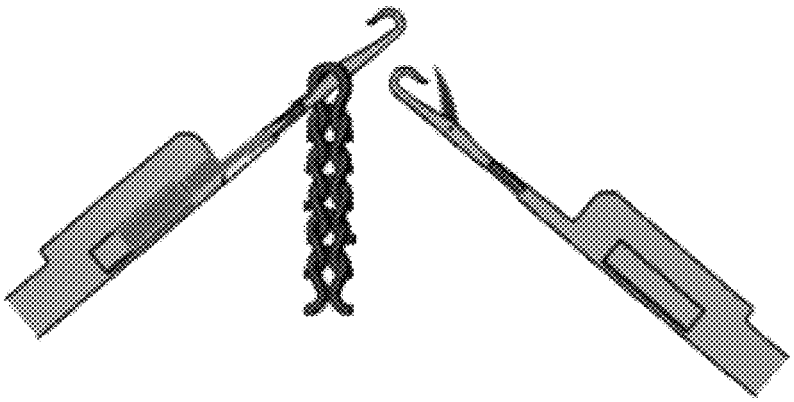

FIG. 9A shows a series of stitches previously formed. The first needle 910*a* advances into an opening in a previous stitch in FIG. 9B. Once two or more threads or yarns 919*a* and/or 918*b* are provided by yarn feeders 920*a* and 920*b*, the first needle 910*a* retracts as indicated by the arrow in FIG. 9C. As the first needle 910*a* retracts, the corresponding pivotable latch 912*a* catches the previously formed stitch 901*a* causing the latch 912*a* to pivot as indicated by the arrow in FIG. 9E. As the needle 910*a* further retracts, the hook 914*a* catches the two or more threads or yarns 919*a* and/or 918*b* and pulls the threads through the opening of the previously formed loop as shown in FIGS. 9G and 9H. Once the new loop 901*b* is formed as shown in FIG. 91 the procedure is again repeated until the individual loops of the loop portion (e.g., 110A and/or 110B in FIGS. 1A and 1B) are fully covered.

Figure 10A:
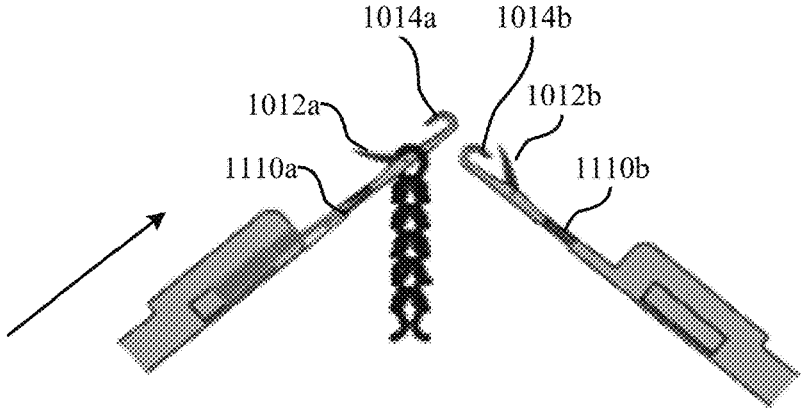
Figure 10B:
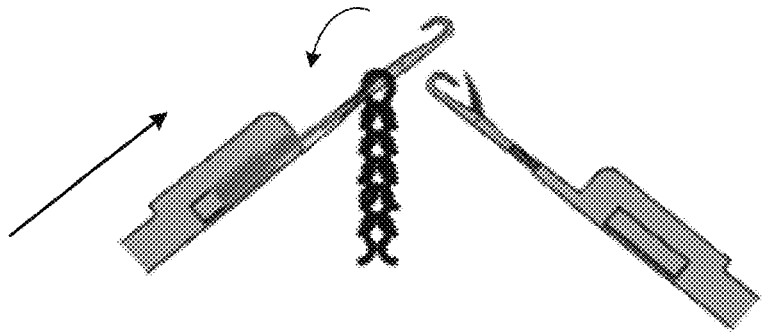
Figure 10C:
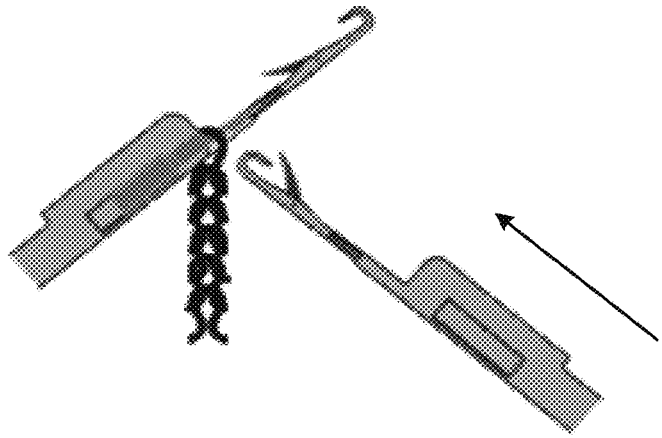
Figure 10D:
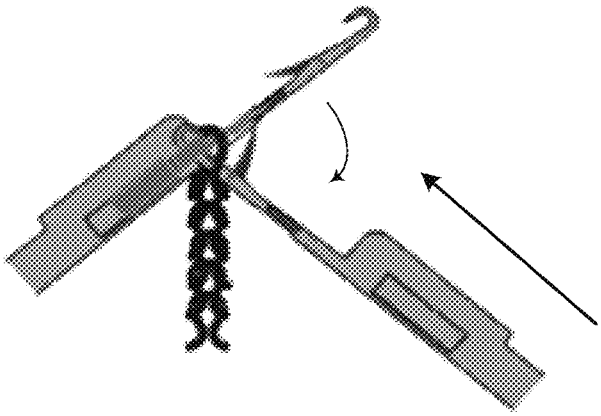
Figure 10E:
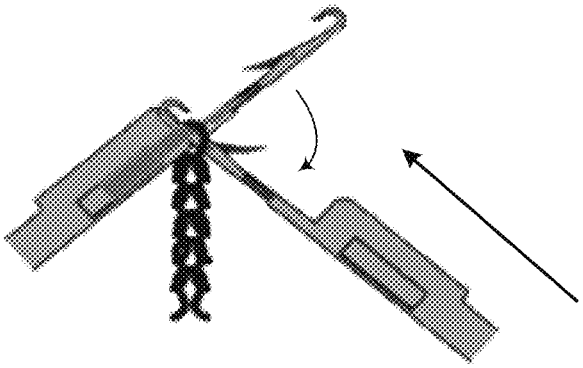
Figure 10F:
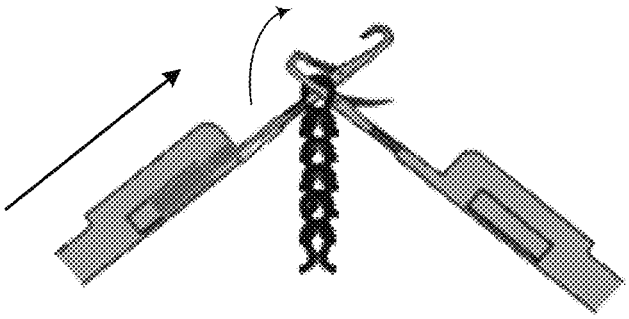

In one aspect of the disclosure, a transferring process may be implemented to lock the formed plurality of loops of the loop portion (e.g., loop portion 110A and/or 110B in FIGS. 1A and 1B) to the knitted article. FIG. 10A-10C show example steps of the transferring process.

As mentioned above, the knitted article may be manufactured a machine with a plurality of needles, i.e., a first needle 1110*a* and a second needle 1110*b*, the first needle 910*a* and/or the second needle 1110*b* may for example each be single needles in a row of a plurality of needles. The first needle 1110*a* and second needle 1100*b* may be analogous with the first needle 910*a* and the second needle 910*b* in FIGS. 9A-9K above.

Each of the needles may include a corresponding pivotable latch 1012*a* and/or 1012*b* and a hook at ends thereof, e.g., corresponding hooks 1014*a* and/or 1014*b*. In one aspect, each one of the needles 1110*a* and/or 1110*b*, including the rows of needles (not shown) may be moveable individually, so that every single latch needle may be controlled to catch a thread for stitch formation. It is noted that FIGS. 10A-101 show various stages of the transfer. To avoid obstruction of the views, reference numbers are only provided in FIGS. 10A-101 where necessary to provide further clarification from the labeled components in FIG. 10A.

Figure 10G:
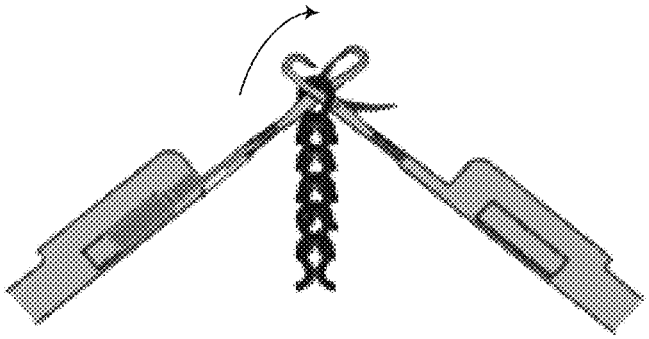
Figure 10H:
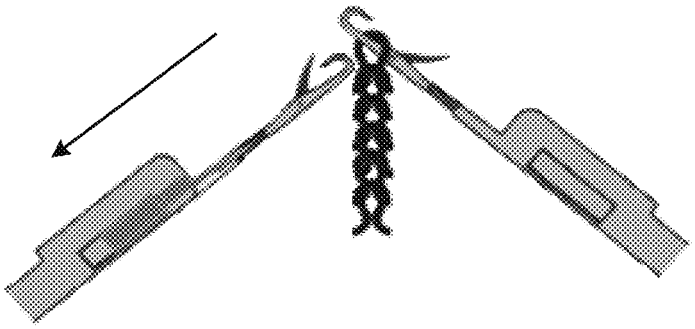
Figure 10I:
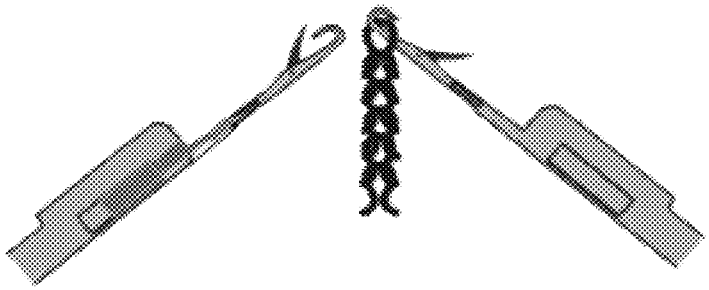

FIG. 10A shows a series of stitches previously formed. The first needle 1100*a* advances into an opening in a previous stitch in FIG. 10A. As the first needle 1110*a* advances, the corresponding pivotable latch 1012*a* rotates as indicated by the arrow in FIG. 10B to allow an opening of the previously formed stitch to advance downward on the first needle 1110*a* as shown in FIG. 10C. Once the previously formed stitch has fully advanced down the first needle 1110*a*, the second needle 1110*b* advances in the direction of the arrow in FIGS. 10C and 10D. The second needle 1110*b* advances into an opening in the previously formed loop causing rotation of the second needle pivotable latch 1012*b* in the direction indicated in FIGS. 10D and 10E. The first needle 1110*a* is then advanced as indicated by the arrow in FIG. 10F causing rotation of the first needle pivotable latch 1012*a* in the direction shown in FIGS. 10F and 10G. Once the first needle pivotable latch 1012*a* full pivots as shown in FIG. 10G, the previously formed stitch is free from the first needle 1110*a* as shown in FIG. 10H. The first needle 1110*a* may then retract leaving the previously formed stitch on the second needle 1110*b*. The transfer steps described above allows the plating to occur continuously while forming the loop portion by dropping stitches or pressing-off stitches. The combination of the aforementioned stitching, drop stitching, and plating stitches lock or otherwise anchor the loops of the loop portion and allow the article to be formed as an uninterrupted knit article (i.e., without the need to separately attach a loop portion of a hook-and-loop fastener system).

This written description uses examples to disclose aspects of the invention, including the preferred embodiments, and also to enable any person skilled in the art to practice the aspects thereof, including making and using any devices or systems and performing any incorporated methods. The patentable scope of these aspects is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims. Aspects from the various embodiments described, as well as other known equivalents for each such aspect, can be mixed and matched by one of ordinary skill in the art to construct additional embodiments and techniques in accordance with principles of this application.

What is claimed is:

1. A knit article with an integrated loop fastener portion that is configured to be attached to and detached from a hook fastener, the article comprising:

a knit section forming a body of the article; and a loop section forming the integrated loop fastener portion and comprising dropped stitches of the knit section to form individual loops of the loop section, wherein the individual loops of the loop section are plated to lock the individual loops of the loop section, and wherein the knit section and the individual loops of the loop section are knit from a single, uninterrupted, textile.

2. The knit article of claim 1, wherein the integrated loop fastener portion is plated via a second uninterrupted textile.

3. The knit article of claim 1, wherein the integrated loop fastener portion is knitted from the same material as the knit article.

4. The knit article of claim 1, wherein the knit section forms a flap of a sandal and the integrated loop fastener portion is configured to be disconnectedly connected to a hook portion of the sandal.

5. The knit article of claim 1, wherein the knit section is formed by weft-knitting.

6. A method of forming a knitted article with an integrated loop fastener portion that is configured to be attached to and detached from a hook fastener portion, the method comprising:

knitting a knit section of the article via a first yarn feeder supplying a first yarn;

knitting the integrated loop fastener portion by forming dropped loops of the first yarn supplied by the first yarn feeder to form individual loops of the integrated loop fastener portion; and plating each of the individual loops to lock the individual loops of the integrated loop fastener portion.

7. The method of claim 6, wherein the plating is formed via a second yarn feeder supplying a second yarn and the first yarn feeder supplying the first yarn.

8. The method of claim 7, wherein the first yarn provided by the first yarn feeder is an uninterrupted length of yarn forming the knit section and the dropped loops.

9. The method of claim 7, wherein the plating is formed via an uninterrupted length of the second yarn.

10. The method of claim 7, further comprising a kicking step for passing the first yarn from a first needle to a second needle during a knitting process.

11. The method of claim 7, wherein the knit section and the integrated loop fastener portion are formed of the same material.

12. The method of claim 11, wherein the plating is formed of the same material as the dropped loops and the knit section.

13. The method of claim 7, wherein the article is formed using an automated knitting machine.

14. The method of claim 7, wherein the article is connected to a sandal sole.

* * * * *